US007975412B2

(12) United States Patent
Davidson

(10) Patent No.: US 7,975,412 B2
(45) Date of Patent: Jul. 12, 2011

(54) DECORATIVE SIGNPOST

(75) Inventor: Bradley W. Davidson, Mission, KS (US)

(73) Assignee: Sign Post Transformations LLC, Mission, KS (US)

( * ) Notice: Subject to any disclaimer, the term of this patent is extended or adjusted under 35 U.S.C. 154(b) by 0 days.

(21) Appl. No.: 12/690,653

(22) Filed: Jan. 20, 2010

(65) Prior Publication Data

US 2010/0115813 A1 May 13, 2010

Related U.S. Application Data

(63) Continuation-in-part of application No. 11/966,045, filed on Dec. 28, 2007, now Pat. No. 7,762,016.

(51) Int. Cl.
*G09F 15/00* (2006.01)

(52) U.S. Cl. ..... 40/607.01; 40/611.01; 52/834

(58) Field of Classification Search ..... 40/607.03; 52/169.9, 834, 832
See application file for complete search history.

(56) References Cited

U.S. PATENT DOCUMENTS

| | | | |
|---|---|---|---|
| 218,882 | A | 8/1879 | Hopkins |
| 2,802,291 | A | 8/1957 | Bach et al. |
| 4,574,507 | A | 3/1986 | Elliott |
| 4,912,901 | A | 4/1990 | Jerry |
| 5,116,204 | A | 5/1992 | Power et al. |
| 5,197,819 | A | 3/1993 | Hughes |
| 5,487,618 | A | 1/1996 | Cox |
| 6,061,939 | A | 5/2000 | Gildea |
| 6,113,055 | A | 9/2000 | Salman |
| 6,269,570 | B1 | 8/2001 | Miles |
| 6,494,640 | B2 | 12/2002 | Roller |
| 6,516,573 | B1 | 2/2003 | Farrell et al. |
| 6,898,882 | B2 | 5/2005 | Kim |
| 6,986,220 | B2 | 1/2006 | Kaulbach |
| 7,167,103 | B2 | 1/2007 | Warren et al. |
| 2006/0174526 | A1 | 8/2006 | Kekeis et al. |

OTHER PUBLICATIONS

Office Action issued in related U.S. Appl. No. 11/966,045 dated Feb. 23, 2010, 7 pages.
Response to Office Action filed in related U.S. Appl. No. 11/966,045 dated Mar. 9, 2010, 5 pages.
Office Action issued in related U.S. Appl. No. 11/966,045 dated Apr. 5, 2010, 8 pages.
Response to Office Action filed in related U.S. Appl. No. 11/966,045 dated Apr. 9, 2010, 6 pages.
Select File History of related U.S. Appl. No. 11/966,045, dated Feb. 12, 2008 to Jan. 19, 2010, 43 pages.
Notice of Allowance issued in related U.S. Appl. No. 11/966,045 dated Jun. 3, 2010, 12 pages.

*Primary Examiner* — Cassandra Davis
(74) *Attorney, Agent, or Firm* — Lathrop & Gage LLP

(57) ABSTRACT

A system and method for installing a decorative exterior on a standard signpost is disclosed. A first exterior shell is mounted on one side of the post, and a second exterior shell is mounted on the other. Discs halves are also provided which, when installed between the post and the shells, cause the shells to be securely fastened to the post. In another alternative system, a midsection of the post cover is installed as a tube that slides over two solid discs that are slid onto the post and supported by grommets.

15 Claims, 5 Drawing Sheets

DECORATIVE SIGNPOST

RELATED APPLICATIONS

This application is a continuation-in-part application of U.S. patent application Ser. No. 11/966,045, filed Dec. 28, 2007, now U.S. Pat. No. 7,762,016 the disclosure of which is incorporated herein by reference.

BACKGROUND OF THE INVENTION

1. Field of the Invention

The disclosed systems and methods relates generally to the field of signage technologies. More specifically, the disclosed systems and methods relate to the process of making a signpost more decorative.

2. Description of the Related Art

Conventionally, most signposts are constructed comprising a vertical post of some sort. In some instances, this post might be an elongated piece of square tubing. The tubing is longitudinally perforated on opposite sides with holes which are offset at some interval (e.g., 1 inch). The sign is secureable at the top or some other vertical location using bolts and nuts. In other instances, U-shaped channel posts are used. These posts are not comprised of enclosed tubing, but instead are a uniform vertical member having a flat inside portion which includes a plurality of vertically spaced holes (which are used to secure the sign), two side walls extending divergently angularly outward and terminating in two laterally extending outer portions.

In other instances, more decorative signposts have been used. The more decorative variety typically are made of a unitariliy-constructed piece of aluminum. They tend to look much nicer than the more prevalent posts discussed above.

SUMMARY

The present invention is defined by the claims below. Embodiments of the present invention include a system for enabling the installation of an exterior on a post. The exterior has a decorative appearance in one embodiment. More specifically, in embodiments the system includes a first exterior portion adapted to be mountable on a first side of the post, and a second exterior portion adapted to be mountable on an opposite side of the post, the first and second portions together substantially concealing a section of the post. In embodiments, the first and second portions are secured using fasteners. The fasteners are secured through apertures in the post.

The disclosed system also includes insert devices. These devices are included within one or both of the first and second exterior portions and are received onto and conform with an outer shape of the post for the purpose of providing stability to the one or both of the first and second exterior portions. In embodiments, the insert devices comprise two disc halves. A first disc half has a radially outer surface which conforms with the inside surface of the first exterior portion and a radially inward surface which conforms with the outer shape of the post. A second disc half has a radially outer surface which conforms with the inside surface of the second exterior portion and a radially inward surface which conforms with the outer shape of the post.

In embodiments, the first exterior portion has at least one aperture therethrough which reciprocates with a bore through the first disc half; the second exterior portion has an aperture therethrough which reciprocates with a bore through the second disc half. A fastener is received through the aperture in the first exterior portion; the bore in the first disk, at least one hole in the post; the bore through the second disk, and then the aperture in the second exterior portion to secure all of the first and second exterior portions and the first and second disc halves to the post.

In some embodiments, the system includes a third exterior portion adapted to be mountable on the first side of the post at a location immediately above the first exterior portion, and a fourth exterior portion adapted to be mountable immediately above the second exterior portion; the first and second exterior portions together substantially concealing a base portion of the post; the third and fourth exterior portions together substantially concealing a midsection of the post.

In other embodiments a sign is mountable on the first side of the post at a location immediately above the third exterior portion, and a fifth exterior portion adapted to be mountable immediately above the fourth exterior portion, the fifth exterior portion and a back side of the sign together substantially concealing an upper section of the post.

In some instances a first transition donut is adapted to slide onto the post and then slid down on top of the upper surfaces of the third and fourth exterior portions, and then have a bottom edge of the sign and a lower surface of the fifth exterior portion rest on top of the first transition donut, the transition donut used for the purpose of creating an ornamentally appeasing transition between the third exterior portion and the sign.

In other embodiments, a second transition donut adapted to slide onto the post on top of: (i) an upper edge of the sign and (ii) an upper surface of the fifth exterior portion.

In yet other embodiments, a decorative top cap is received onto the top of the post above the second transition donut.

A method is also disclosed. The method includes providing an exterior shell for the purpose of concealing at least a section of the post; and providing at least one attachment mechanism, the mechanism enabling the shell to be installed on an existing conventional post.

Where the post is a square tube, the method might involve inserting a member coaxially outside the square tube, and shaping an inside surface of the member to conform to an exterior surface of the post, and adapting an outside surface of the member to conform to an inside surface of the exterior shell, and enabling a user to securely fasten the exterior shell to the square tube using the member.

Where the post is a U-shaped channel post, and the method might include inserting a member coaxially outside the post, and shaping an inside surface of the member to conform to an exterior surface of the U-shaped channel post, and adapting an outside surface of the member to conform to an inside surface of the exterior shell, and enabling a user to securely fasten the exterior shell to the U-shaped channel post using the member.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Figure 1:
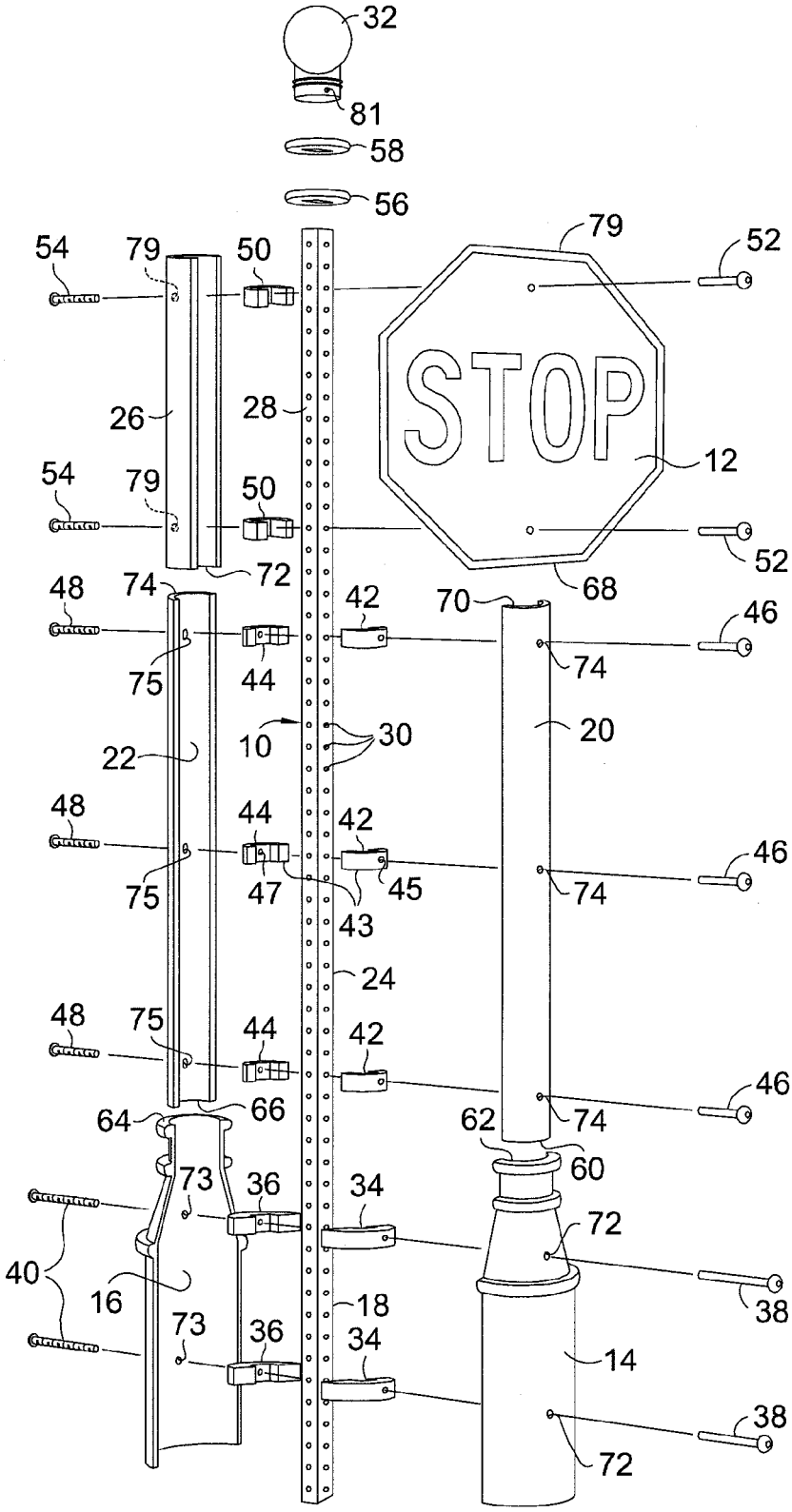
FIG. 1 is an exploded perspective view showing the many components of the system and their orientations before assembly.

The retrofit system of the invention and its environment of use are shown in FIGS. 1-10. Referring first to FIG. 1, the retrofit system is adapted to be assembled onto an existing square-tube signpost 10 which is used to support a sign 12. One skilled in the art will recognize that the system described herein could be adapted for use on numerous sorts of signposts other than signpost 10. The retrofit system comprises of a plurality of exterior portions, which in the disclosed embodiments are decorative shells which are adapted to be secured around the existing signpost 10. Starting from bottom to top, a first exterior portion comprises a front base shell 14, which along with a rear base shell 16 (second exterior portion), are used to substantially (or completely) conceal a lower portion 18 of signpost 10. Similarly, a third exterior portion comprises a mid front shell 20 (third exterior portion) and a corresponding rear mid shell section 22 (fourth exterior portion) are used to conceal a mid signpost section 24. Above that, an upper section 28 of signpost 10 is concealed from the front by sign 12 and from the rear by an upper rear shell portion 26 (fifth exterior portion). As will be discussed in detail later, a plurality of holes 30 will already exist in most conventional square-tube signposts, and will be used to secure the shell features. The signpost is decoratively capped using an ornamental crown 32.

Shell members 14, 16, 20, 22, and 26, are secured to the signpost 10 using a plurality of disk pairs. Each disk pair comprises two halves. As can be seen in FIG. 1, the disks used to secure shells 14 and 16 to the lower portion 18 of the signpost 10 comprise first halves 34 and reciprocating second halves 36. In general, the disks are used to adapt the decorative shell portions so that they can be fastened securely to the signpost 10. The halves are installed on opposite sides of the post. The disks and shells are secured to one another using fasteners. The fasteners each include both female portions 38 and male portions 40. Each of male portions 40 can be secured into female portions 38 inside of the assembly by screwing them in. One skilled in the art will know that internal threads on the inside of each female portion are engaged by reciprocating threads on each male member.

Similarly, mid front shell portion 20 and opposing rear mid shell portion 22 are secured to mid signpost section 24 of signpost 10 using disk pairs 42 and 44. Because the shells at the midsection of the post are not as wide as the base, the disk pairs 42 and 44 have outside diameters which are not as large. Again, the disks are used to adapt the decorative shell portions to the signpost 10. Male 48 and female 46 fasteners are inserted through bores 45 in spacers to enable the apparatus to be secured.

Figure 5:
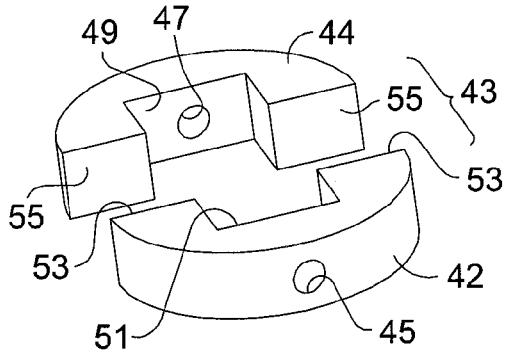
FIG. 5 shows a spacer pair of the invention removed from the other components.

More details regarding the spacer disks are shown in FIG. 5. Although only disc pairs 42 and 44 are shown in this much detail, one skilled in the art will recognize that the basic functionality is much the same for each of the disc pairs. Referring to FIG. 5, it may be seen that each of spacer pair halves 42 and 44 is able to receive the fasteners through bores 45 and 47, respectively. Each disk half also includes an area that is adapted to receive the signpost 10, and conforms to the shape of the particular signpost being retrofitted. For example, a receiving area 51 is shown to exist in half 42, whereas a receiving area 49 is defined into second half 44. It will be noted that these receiving areas are specifically adapted for a square sort of signpost. It should be understood, however, that these receiving areas can be changed and adapted to fit any variety of signpost types. For example, the U-shaped channel signpost embodiment shown in FIG. 6 (which will be discussed in more detail later) is an alternative. One skilled in the art will recognize that these general technologies could be applied equally as well to numerous other existing signpost types. Thus, the scope of the invention should not be limited to the square-shaped embodiment disclosed unless further specified in the Claims. Also on each disk half, are abuttment surfaces. Half 42 has a pair of abuttment surfaces 53. Likewise, half 44 has engagement surfaces 55 which oppose and then abut engagement surfaces 55 when the disk is installed. All of this together comprises a disk pair 43.

A transition donut 56 will rest atop a continuous rim defined by an upper surface 70 of mid front shell section 20 and an upper surface 74 of a rear mid shell 22. Details regarding transition donut 56 installation will be described hereinafter. This transition donut, after installation, will be located immediately below a lower surface 68 of sign 12 and a lower surface 72 of upper rear shell portion 26.

In the disclosed embodiment, sign 12 is attached to upper portion 28 of post 10 using male 52, and female 54 fasteners. The disks used for purposes of attachment, however, are a little different for the upper portions. This is because the sign requires only the use of one of a back set 50 of disks. Because the sign is installed flush against the front face of the signpost 10, disk halves 50 will have elongated forward portions 55 to make the abutment surfaces at the front of the spacer engage the back surface of the sign 12. The details regarding this can be seen in cross-section 3-3 in FIG. 3.

Figure 2:
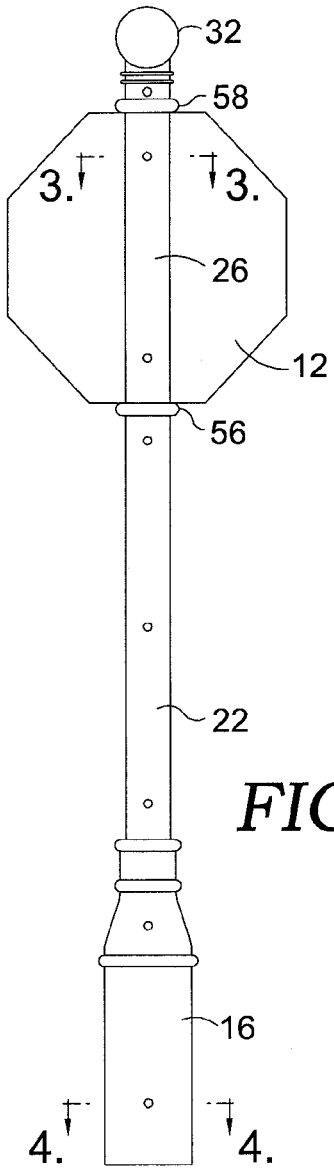
FIG. 2 is a rear view of the system after assembly.
Figure 3:
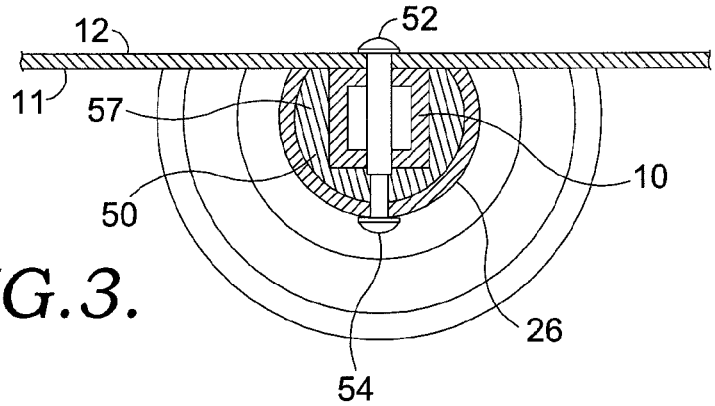
FIG. 3 is a cross-sectional view taken at section 3-3 in FIG. 2.
Figure 4:
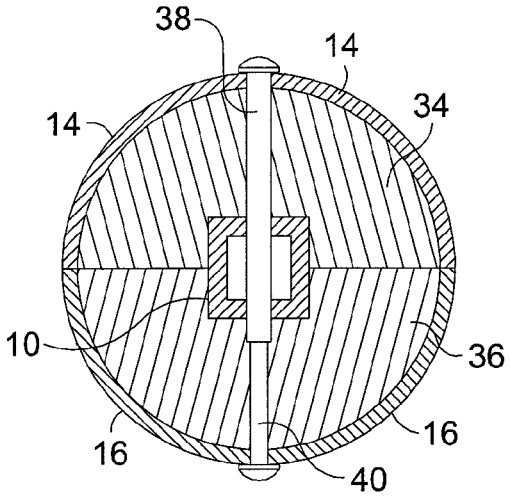
FIG. 4 is a cross-sectional view taken at section 4-4 in FIG. 2.

Similarly, FIG. 4 shows an assembled view of the cross-section taken through the base of the post at section 4-4 in FIG. 2. It should be understood, that a cross-section taken at the middle of the post would resemble that in FIG. 4 except that the shell portions and disk halves would be on a smaller scale relative to the post because of relative thinness.

The process of assembling the system disclosed will now be addressed. Considering that signpost 10 and sign 12 are already existent at some location, or intended to be installed in some conventional process, the first step in installation will be to install shells 14 and 16 around lower portion 18 of post 10 using disc halves 34 and 36. The fasteners 38 will normally be inserted through shell 14 and the disc halves 34. On the back side base, male fasteners 40 will be inserted through shell 16 and spacer halves 36 prior to insertion into holes 30. Once these preliminary steps have occurred, both assembled shell/disc/fastener halves will be connected around the post by threadingly engaging male 40 and female 38 fasteners through the post holes 30 at the proper desired vertical location. This will require the installer to determine which holes should be selected to ensure proper vertical location for that particular shell section such that the base is located at ground level. This should be possible considering that holes 30 are amply closely related such that any gap between the ground and the lower extremes of shell halves 14 and 16 will be minimized to be unnoticeable.

Once halves 14 and 16 have been installed as discussed, shells 20 and 22 adapted for midsection 24 of the signpost 10 are installed in much the same fashion. As a preliminary, female fasteners 46 are preinserted through shell 20 and spacer halves 42 (before placement on signpost 10). For the back, male fasteners 48 are preinserted through holes in shell 22 and also through spacer halves 44 before installation onto the post. (See FIG. 1.) Next, the opposing shell assemblies are brought together around the post and the fasteners 46 and 48 inserted through the proper holes such that the upper surfaces of the base sections 62 and 64 abut the lower surfaces 60 and 66 of the midsection shells.

In one embodiment, holes 72 and 73 on shell portions 14 and 16 respectively, along with holes 74 and 75 on shells 20 and 22 respectively are all predrilled at locations which make the placement of the base with the midsection properly match up vertically when installed. This can be done by considering the proper signpost hole configurations. In another embodiment, the holes 72, 73, 74, and 75 could be drilled at desired locations on site. Alternatively still, one or more transition donuts, like donuts 56 and 58, could be slid down over signpost 10 placed on top of upper surfaces 62 and 64 before securing on midsection halves 20 and 22 thus closing the gap between the lower surfaces 60 and 66 from below.

Once the base and midsection shells have all been secured as discussed, a donut 56 is slid onto and down signpost 10 until it rests atop upper surfaces 70 and 74. This donut is useful in creating a continuous looking and ornamental appearance at the interface of the sign 12 and the top of front midsection shell 20. It is also possible that two or more donuts could be used to fill any gaps as necessary. Once donut 56 is in place, the user may temporarily place sign 12 on the upper portion 28 of post 10 by sliding female fasteners 54 through a pair of holes 77 in sign 12, and then mounting the sign into holes 30 in upper portion 28.

Like with the base and midsection shells, upper shell 26 on the back side is secured by preinstalling fastener 54 through holes 79 in shell half 26, then through holes bored through disc halves 50, before being fixed to female fasteners 54 inside signpost 10. As can best be seen in FIG. 3, the back discs 50 are not shaped like the disc halves 34, 36, 42, and 44 already discussed. Looking more specifically and in more detail at FIG. 3, the forward extending portions 57 on each side of the disc are adapted to fit around the signpost and also support the sign from the back. This engagement of the back side 11 of sign 12 provides stability. Similarly, the back shell 26 is a cylinder with a longitudinally removed section and is thus adapted so that instead of extending only half way around symmetrically, it extends to form almost ¾ of a circle in cross-section. This back shell is also made to be flush at its forward most points with the back side of the sign further enhancing stability. In addition to stability, the back shell arrangement creates a better and more continuous looking ornamental appearance when viewing the sign from behind as shown in FIG. 2.

Now that the sign 12 and back shell 26 have been fastened together, a second donut 58 is slid over the top of signpost 10 down onto the upper surfaces of the back shell 26 and a top edge 79 of the sign 12. After that, an ornamental top cap 32 is installed. The top cap 32 has a hollowed out rectangular shaped receiving area in its bottom. This receiving area (not shown) enables the top of signpost 10 to be received snuggly and slidingly inside the top cap bottom. Once slid on atop the signpost, top cap 32 is secured using a male and female fastener arrangement through a hole in the cap that goes through the post holes 30 and out the other side.

Once the entire apparatus has been installed as discussed above, it will have the benefits of low cost and replaceability.

Figure 6:
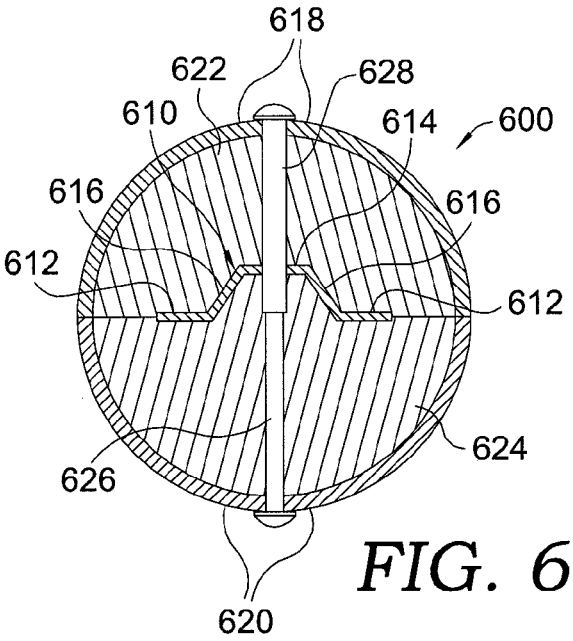
FIG. 6 shows a cross-sectional view showing an alternative embodiment where the systems and methods are used with a U-shaped channel post.

An alternative embodiment for a U-channel signpost is disclosed in FIG. 6. The FIG. 6 cross-section could be considered to be taken from the signpost at some vertical location similar to that disclosed in FIG. 4. For a U-channel embodiment, the shell halves would remain essentially the same as those disclosed in an embodiment disclosed in FIGS. 1-5. Referring to the figure, it can be seen that a cross-sectional view 600 shows the U-channel post 610 has flat lateral portions 612, a flat center portion 614, and angled portions 616 which are angled out from the flat center 614 linking it with the flat lateral portions 612. Also like the FIGS. 1-5 embodiment, this version has a decorative forward and rear shell portions 618 and 620 respectively. The decorative shell portions are securely fastened to the post using disc halves 622 and 624. Also like with the earlier embodiment, the shell portions and disc halves are secured to the post using male 626 and female 628 fasteners through holes in the post (not shown).

Unlike the earlier embodiments, however, the discs 622 and 624 are adapted to conform to the cross-sectional profile of the U-shaped post 610 instead of that of a square tube or some other signpost cross-sectional shape. Because the disc portions have been adapted to secure the U-channel embodiment, the decorative shells are securely held. FIG. 6 illustrates an alternative embodiment, but also shows that by conforming the disc portions to conform to various shapes, any number of particular signpost configurations could be accommodated.

Figure 7:
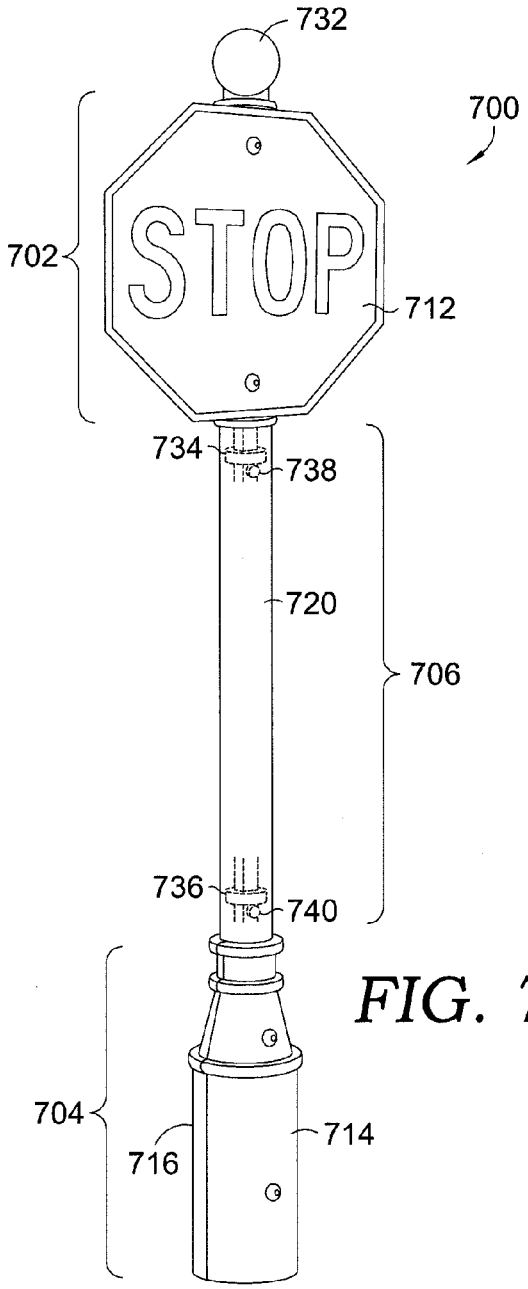
FIG. 7 shows a perspective view of an embodiment of the signpost.

Yet another alternative embodiment for the signpost is shown in FIGS. 7-10. Referring first to FIG. 7, this embodiment 700 includes an upper arrangement 702 and a lower arrangement 704 which are the same as disclosed in the FIG. 1-2 embodiments. A middle portion 706, however, has been changed. One difference is that instead of two halves (e.g., halves 20 and 22 in FIGS. 1-2), an integral tube 720 is used to cover the post's midsection 706. This is accomplished using two solid disks, an upper disk 734 and a lower disk 736. Unlike the FIGS. 1 and 2 embodiment, the disks are integral and solid rather instead of being formed out of halves like in past embodiments.

With each of disks 734 and 736, an aperture formed through each of disks conforms to the outer shape of the post. Thus, in the FIG. 7 embodiment, where the system 700 is installed on a square post 708, the aperture through the disk is square-shaped in order to be received onto and conform to the outer surface of the post. The outer surfaces of each of disks 734 and 734 is cylindrical, and sized to be equal or slightly smaller in diameter to the inside surface of the tubular member 720 so that they together adequately support the tubular member 720 from within.

Figure 9:
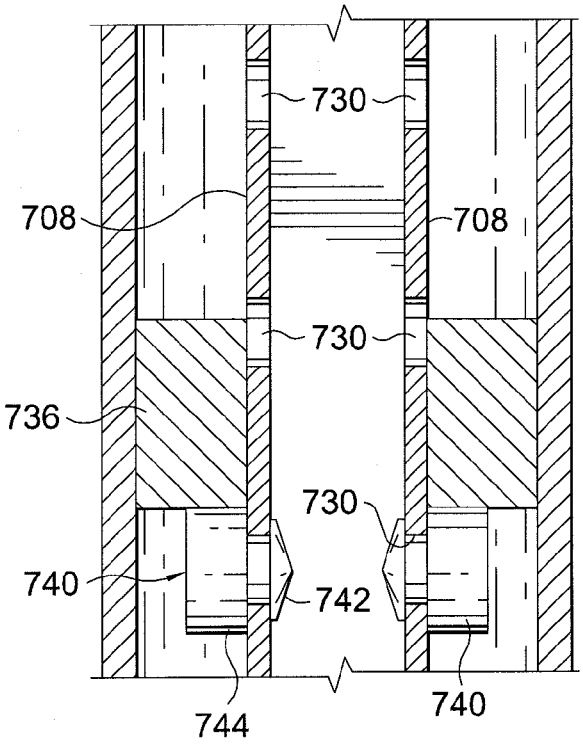
FIG. 9 shows a sectional view taken from 9-9 in FIG. 8.
Figure 10:
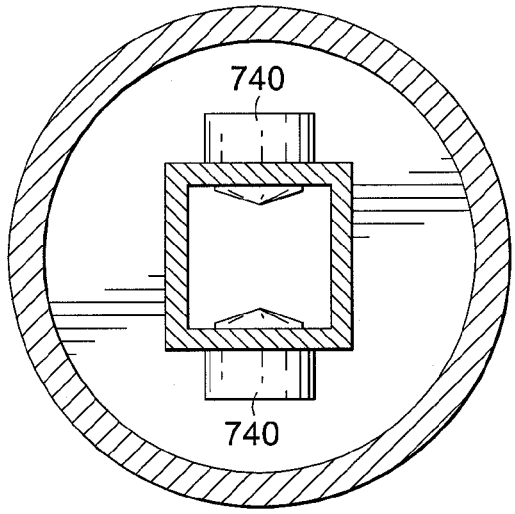
FIG. 10 shows a sectional view taken from 10-10 in FIG. 8.

In FIG. 7 it can be seen how disks 734 and 736 are supported vertically after installation on rubber grommet pairs 738 and 740, respectively. Grommets like those used in pairs 738 and 740 are well known, and are comprised of a flexible elastic material, e.g., rubber. Each has an insertion end (e.g., end 742) which is inserted in the hole 730. With this sort of grommett, once it inserted past a point, it is as shown in FIG. 9. This retains the grommet in place after it is snapped in place by pushing it in. A main body portion 744 then sticks out so that its upper portion can support disk 736 as shown.

Figure 8:
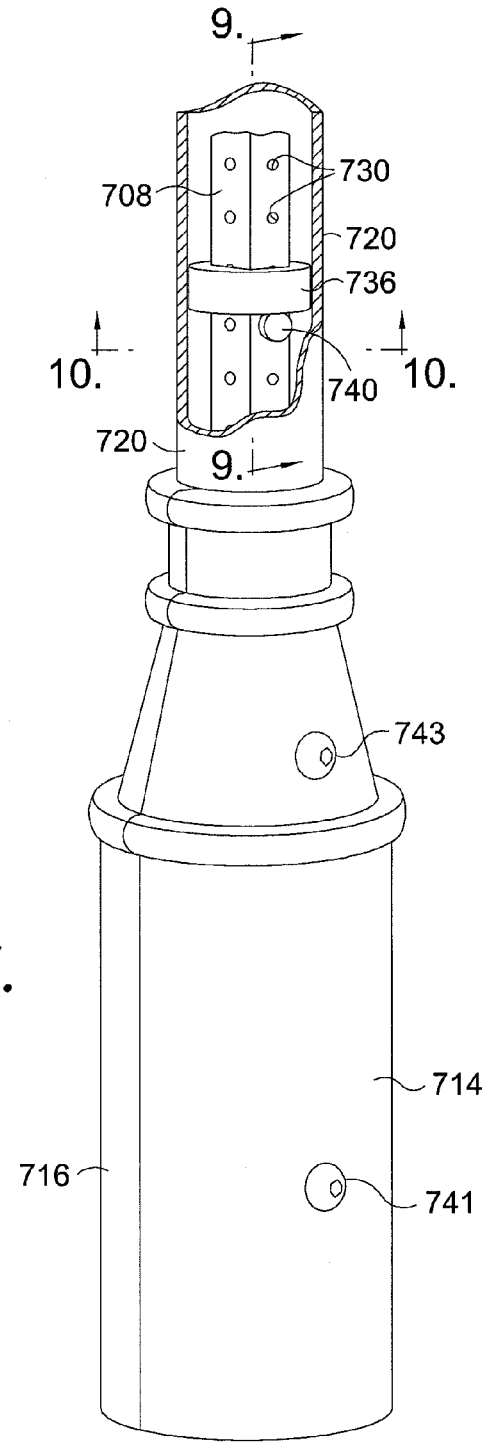
FIG. 8 shows an exploded view exposing the internals at a lower portion of the FIG. 7 embodiment.

Although pairs are used in the disclosed embodiments, it is possible that single grommets (not pairs) could be used to support each disk. But pairs are used in the preferred embodiment to increase stability in that the disks will be supported on two opposite sides. The grommet pairs used are inserted into holes on opposite sides of the post 708 and stick out such that they support the underside of the disk. See FIG. 9. It should be understood that although only one grommet from each pair is visible in FIGS. 7 and 8, FIG. 9 shows how the grommets in pair 740 stick out from opposite sides after they are inserted into the opposing post holes 730.

Because gravity causes disks 734 and 736 to rest on grommets 738 and 740, there is no need for any fastener like those used in the embodiment disclosed in FIGS. 1-6. This makes for quick and easy installation. The initial steps in the installation of the embodiment disclosed in FIGS. 7-10 is accomplished in much the same manner as was describe already regarding the FIG. 1-6 embodiments. For example, the installation process for installing base shell portions 714 and 716 is the same as that used for installing base shells 14 and 16 in FIG. 1. (and has already been described above). Fasteners 741 and 743 are used to assemble bottom portion 704 by fastening shells 714 and 716 about the post 708 using spacers (not shown, but the same as spacers 34 and 36 in FIG. 1).

But after that, the process for installing middle portion 706 is different than has been described regarding the earlier embodiments. More specifically, the installer inserts grommet pair 740 into opposing sides of the post 708 in a position slightly above the upper parts of shells 714 and 716 as shown in FIG. 8. As described already, the insertion end (e.g., 742) is received into each hole to the point that it is locked therein. This leaves the body portion 744 of each grommet in pair 740 sticking out of opposite sides of the square tube post. After that, a lower integral disk 736 is brought over the top of post 708 and the square aperture in disk 736 receives the top of the post. (The upper section 702, including sign 712, has not yet been installed.) Then disk 736 is slid down post 708 until it rests on the grommet pair 740 as shown in FIG. 8.

After the lower integral disk 736 is in place, each grommet in pair 738 is inserted into opposite holes at a location just below where the sign 712 is intended to be installed. The grommets are then pushed in so that they are locked in place. Then, the upper disk 734 can be brought over the top of the post and slid down to rest on the grommet pair 738 as shown in FIG. 7.

The tube 720 can then be is installed. The length of tube 720 can be premeasured, or, it can be cut on site. The tube can be slid down over the post and installed disks 734 and 736. In the case the tube is not premeasured, it may marked and removed, then cut so that it, when put in place, extends slightly above the upper disk 734. Alternatively, the yet-to-be measured tube 720 could be cut on the post to the desired height slightly above the disk. Alternatively, the tube could be precut to the proper height if the standard post height and other measurements are known in advance. With the precut scenario, the tube is simply slid on ready to go.

Once tube 720 is in place, the rest of the installation (upper section 702) is executed above the already-installed middle section 706 in the same manner as described already regarding the installation processes for parts 12, 26, 32, 50, 52, 54, 56, and 58 as described above. One alternative that has been discovered is that half-donuts 50 are oftentimes unnecessary and that the fasteners 52, 54 can be fastened to the sign 12 directly through the upper back shell 26.

In yet another embodiment, the system disclosed in FIGS. 7-10 could be used to install the overall cover (comprising sections 702, 704, and 706) onto a U-post system. (See U-post cross section shown in FIG. 6). For a U-post, the processes involving the integral disks 734 and 736 would be the same. Each disk would have an aperture defined in it that conformed to the cross-sectional shape of the U-post, and the outside of each disk would again correspond to the inside diameter of the tube 720. Further, only one grommet could be used to support each disk, because a U-post has only one set of vertical holes. Other than those differences, the rest of the system and processes would be the same as described using the U-post embodiment shown in FIG. 6 and described in the related portions of the specification above.

Further, it should be noted that these same systems could have desirable use on other kinds of posts. For example, mail box posts, posts for satellite dishes, and numerous other types of uses. Thus, it should be recognized that the broad concepts disclosed herein are not limited to any particular signpost shape or any particular application.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

I claim:

1. A system for enabling the installation of an exterior on a conventional post, the post supporting a sign, said exterior having a decorative appearance, said system comprising:

a first exterior half shell portion adapted to be mountable on and conceal a first side of said post;

a second exterior half shell portion adapted to be mountable on an opposite side of said post, said first and second portions together substantially concealing and coaxially enclosing a section of said conventional post;

at least one attachment mechanism, said mechanism enabling said first and second half shell portions to be installed on said conventional post;

a tubular member adapted to be installed on the post above the first and second exterior half shell portions and coaxially enclose the post; and a back shell with securing devices, the back shell, when installed, covering the back of the post behind the sign.

2. The system of claim 1 wherein said attachment is a fastener, said fastener securing said first exterior portion to said second exterior portion through an aperture in said post.

3. The system of claim 1 comprising:

at least one spacer device, said spacer device being received onto and conforming with an outer shape of said post and supporting one or both of said first and second exterior portions.

4. The system of claim 3 wherein said post is a square tube.

5. The system of claim 3 wherein said post is a U-channel post.

6. A system for enabling the installation of an exterior on a post, the post having a sign-receiving area where a sign is mountable, said exterior having a decorative appearance, said system comprising:

a first exterior shell portion adapted to be mountable on a first side of a lower section of said post;

a second exterior shell portion adapted to be mountable on an opposite side of said lower section of said post, said first and second portions together substantially concealing said lower section of said post;

a third exterior portion adapted to slide onto said post from above and be coaxially spaced from said post to substantially cover all sides of a section of said post at a location immediately above said lower section of said post; and an upper exterior portion for substantially concealing an upper section of said post behind the sign receiving area.

7. A system used for the purpose of providing a decorative exterior on a conventional post, said conventional post having a series of vertically displaced holes and a sign, said holes running axially up and down the post, said system comprising:

a plurality of shell portions;

a plurality of spacers used for the purpose of securely fastening said shell portions to said post;

an inner surface on each spacer which conforms to a shape of a surface on said post;

an outer surface on each spacer which conforms to an inner surface of said shell;

means for vertically supporting said spacers at a desired vertical locations on said post, said means including mechanisms which are inserted through said vertically displaced holes in said post to support said spacers at a desired vertical positions on said post; and the plurality of shell portions substantially conceal the post including the portion of the post behind the sign.

8. A method of providing a decorative cover over an existing sign post, the post including an area on a forward side at an upper location of the post, the area being adapted to receive a sign, said method comprising:

providing an exterior shell for the purpose of concealing at least a section of said post;

providing a first attachment mechanism and a second attachment mechanism, said first and second attachment mechanisms enabling said shell to be installed on an existing conventional post;

installing an attachment mechanism coaxially between said post and an inside surface of said shell; and adapting an outside surface of each of said first and second attachment mechanisms to conform to said inside surface of said shell;

providing a covering member to be installable over a rearward side of said post at the upper location of the post to cover an opposite side of the post which would be behind the sign.

9. The method of claim 8 comprising:

providing each attachment mechanism in two halves, each of said halves being installable around said post using a fastener which passes through a hole in said post.

10. The method of claim 8 comprising:

providing each attachment mechanism as an integral disk which defines an aperture therethrough;

shaping said aperture in the shape of a cross sectional shape of said post such that said attachment mechanism is vertically slideable on said post;

providing a supporting mechanism, said supporting mechanism being securable into a hole in said post such that said attachment mechanism can be slid down on said post and rest on said supporting mechanism.

11. A method of decorating a post, said method comprising:

providing at least one exterior cover portion for the purpose of concealing at least a section of said post; and providing a first attachment device and a second attachment device, said first and second devices enabling said at least one cover portion to be installed on an existing conventional post; and providing said at least one cover portion such that, when installed, said cover portion is arranged to coaxially enclose said post, and said first and second attachment mechanisms being located coaxially between said post and said at least one cover portion at different vertical positions on said post; and;

providing a rear shell covering for concealing an upper portion of the post behind a sign such that the post is substantially concealed from view.

12. The method of claim 11 comprising:

shaping an inside surface of said first and second devices to conform to a shape of an exterior surface of said post;

adapting an outside surface of each of said first and second attachment devices to conform to corresponding internal surfaces of said exterior shell.

13. A covering system for a conventional post, the post having a sign-receiving area, said system comprising:

a first disk;

a second disk;

each of said first and second disks having apertures defined therethrough, said apertures shaped to conform to a cross sectional shape of said post so that each of said first and second disks are slideable on said post;

means to secure said first and second disks at different positions on said post;

a tube having an inside diameter being one of: (i) substantially equal to, and (ii) slightly smaller than an outside diameter of each of said first and second disks, said tube being slideable over and secureable over said first and second disks over said post;

a pair of half discs being securable to two spaced apart locations at an upper portion of said post behind the sign-receiving area; and a back cover portion mountable over said half discs to conceal the post behind the sign-receiving area.

14. The system of claim 13 wherein said post is one of a square post and a U-Channel post.

15. The system of claim 13 wherein said means to secure said first and second disks are grommets.

* * * * *